US005516113A

United States Patent [19]

Hodge

[11] Patent Number: 5,516,113

[45] Date of Patent: May 14, 1996

[54] RESISTIVE MATRIX TARGETING SYSTEM

[76] Inventor: Robert B. Hodge, P.O. Box 428, Greenfield, N.Y. 12833

[21] Appl. No.: 410,741

[22] Filed: Mar. 27, 1995

[51] Int. Cl.[6] ..... F41J 5/04

[52] U.S. Cl. ..... 273/371; 178/20

[58] Field of Search ..... 273/371, 372, 273/373

[56] References Cited

U.S. PATENT DOCUMENTS

| | | | |
|---|---|---|---|
| 3,580,579 | 5/1971 | Scharz et al. | 273/373 |
| 3,602,510 | 8/1971 | Knippel | 273/371 |
| 3,656,056 | 4/1972 | Dalzell, Jr. | 324/65 R |
| 3,705,725 | 12/1972 | Thalmann | 273/373 |
| 3,854,722 | 12/1974 | Ohlund et al. | 273/373 |
| 4,204,683 | 5/1980 | Flippini et al. | 273/371 |
| 4,240,640 | 12/1980 | LaMura | 273/373 |
| 4,563,005 | 1/1987 | Hand et al. | 273/371 X |
| 4,659,090 | 4/1987 | Kustanovich | 273/376 |
| 4,786,058 | 11/1988 | Baughman | 273/371 |
| 5,419,565 | 5/1995 | Gordon et al. | 273/371 X |

OTHER PUBLICATIONS

"Gauss and Gauss–Jordon Methods" pp. 98–104 Publication date unknown.

*Primary Examiner*—William H. Grieb
*Attorney, Agent, or Firm*—Milton S. Gerstein

[57] ABSTRACT

The invention is a target system capable of determining projectile entrance by detecting loss resistors formed by a graphic colloidal suspension coating of conductive ink placed beneath a graphic target. The target is a low cost sheet of flexible paper positioned by use of a tractor feeder. Actual loss of resistors is interpreted by a microprocessor running a grid simulation program. Upon loss of any one particular resistor, the microprocessor interprets the target to determine what resistors remain thereby providing a history of projectile penetration. The results of the target penetration can be viewed from a remote video display terminal.

20 Claims, 6 Drawing Sheets

TARGET SEQUENCING FLOW CHART

COMPUTER TARGET ANALYSIS FLOW CHART

RESISTIVE MATRIX TARGETING SYSTEM

A portion of the disclosure of this patent document contains material which is subject to copyright protection. The copyright owner has no objection to facsimile reproduction by anyone of the patent document or the patent disclosure, as it appears in the Patent & Trademark Office patent file or records, but otherwise reserves all copyright rights whatsoever.

FIELD OF THE INVENTION

This invention relates generally to target systems, and, in particular, to a resistive matrix targeting system having the ability to measure current shifts with which the exact location of a projectile penetration is determined.

BACKGROUND OF THE INVENTION

The use of a target dates back to early times when archers competed in contests or needed to perfect their skills for hunting purposes. Modern day has all but replaced archery with firearms capable of instantly sending a projectile, commonly referred to as a bullet, to and through a target. The firearm allows an operator to simply pull a trigger to activate a bullet having a self-contained explosive magazine. In fact, firearms such as pistols and rifles have been perfected to the point that they can deliver a projectile over a very large distance at such a velocity that the projectile maintains near perfect trajectory. The aiming of the firearm is a skill, and those involved in law enforcement and military, as well as sporting events, must practice to perfect it.

For this reason, targets are commonly used for both sporting-type recreational events, as well as in the training of law enforcement personnel and military. However, due to the greater distances that a bullet can travel, it is not uncommon for the target to be moved to a location making it difficult to determine how accurate the shooter was in penetrating the target. For this reason, a number of prior-art patents have attempted to address this problem by presenting targets whose penetration can be determined at a distance.

U.S. Pat. No. 3,580,579 discloses a target apparatus having at least two electrically insulated panel sheets which are temporarily electrically connected when a projectile penetrates. The time interval between the pulses is dependent upon the position of the hit portion of the projectile of the target. This requires the two electrical panel sheets to be placed at inclined planes in order to determine timing and location of the projectile.

U.S. Pat. No. 3,705,725 discloses a target for indicating the score of projectile based upon two electrically conductive sheets having a circuit which utilizes shift registers which is conducted to an oscillator. The pulses of the oscillator are directed to a counter on a receiver which indicates a value to correspond to the area on the target struck by a projectile.

U.S. Pat. No. 3,656,056 discloses a target having electrical resistant type elements capable of determining when a projectile has passed and from what direction the projectile was sent.

U.S. Pat. No. 3,854,722 discloses a target system having electrically conductive sheet like elements that are spaced apart so as to be transiently electrically connected by a penetrating projectile. The target system can be repaired if a defective conductive sheet is presented by presenting a target mounted on the other so that if damage to a sensitive of two separate units one of which is exchangeably mounted on the other so that if damage to a sensitive zone is uncovered, it can be corrected without replacement of the entire target.

U.S. Pat. No. 4,240,640 discloses a target utilizing a wire screen electrically connected to a resistance responsive network with an output coupled to a recording device. This disclosure teaches sensing of a variation and an electrical parameter during the transverse of a projectile to produce a sharp drop in the electrical resistance by shorting between sensing electrodes.

U.S. Pat. No. 4,786,058 discloses yet another targeting system having sensing lines running down the center of the target relying upon external circuitry to determine if one of the sensing lines has been hit by a projectile. This is an analog system requiring OP amps and RC time constants to determine voltage changes. This disclosure relies upon the sensing of voltage changes in an isolated section which can only detect whether or not the section has been hit. A major drawback is the reliance upon sensing lines which can be rendered inoperable by a wayward projectile.

Thus, what is lacking in the prior art is a targeting system capable of determining the exact location of projectile entrance by use of a computer based analysis.

SUMMARY OF THE INVENTION

The present invention is based on low-cost tractor feed paper having one side coated with spaced-apart horizontal and vertical lines of graphite, colloidal suspension ink. The conductive ink provides a known resistance across converging intersections forming a matrix grid, wherein the destruction of any portion of the grid can be determined by linear analysis. The linear analysis technique locates loss of a resistor from the grid by detecting a resulting current shift when a current fluctuation passes through end points on the grid. The current fluctuation causes a voltage differentiation in sense-resistors, which is converted into a digital format and compared to a computer simulation of the grid.

The loss of a first resistor is detected by a simple, first-approximation "look-up" technique followed by a successive-approximation graphing algorithm based upon the computer simulation model to locate other missing resistors. The current shifts of the grid are simulated, so as to calculate the change that would occur in the sense voltages to verify all of the lost resistors by subtracting the simulated voltages from the voltage changes detected by sense-resistors.

The targeting system of the invention allows for the use of inexpensive, tractor-feed type paper allowing the placement of the target into a position of use by a conventional tractor feed system similar to that used on a dot matrix computer printer. The target is positioned in a frame having a means for attachment for use of a high speed multiplexer with appropriate voltage and ground contacts. A metal shield is provide to protect contacts.

Thus, an objective of the present invention is to provide a low cost targeting system that locates the loss of resistors formed from a matrix grid of conductive ink by comparison to a simulation program, the output of which can be displayed upon a remote computer screen providing an exact location of projectile penetration.

Still another objective of the instant invention is to set forth a graphing algorithm allowing a high speed microprocessor to detect missing resistors.

Yet another objective of the instant invention is to provide a continuous scanning of the target grid to detect each projectile entrance and allow for updating of a simulation model.

Yet another objective of the instant invention is to set forth an electronic history by use of a target that refurbishes itself electronically upon receipt of a projectile.

The present invention is not limited to a target system. The technique employed is equally applicable to any environment where is desired to locate the exact location by determining the location of an affected resistor. Thus, the present invention is readily applicable for use with a computer screen for determining the precise location of a stylus, finger, and the like.

Other objectives and advantages of this invention will become apparent from the following description taken in conjunction with accompanying drawings wherein are set forth, by way of illustration and example, certain embodiments of this invention. The drawings constitute a part of this specification and include exemplary embodiments of the present invention and illustrate various objectives and features thereof.

DETAILED DESCRIPTION OF THE PREFERRED EMBODIMENT

Although the invention will be described in terms of a specific embodiment, it will be readily apparent to those skilled in the art that various modifications, rearrangements and substitutions can be made without departing from the spirit of this invention. The scope of the invention is defined by the claims appended hereto.

Figure 1:
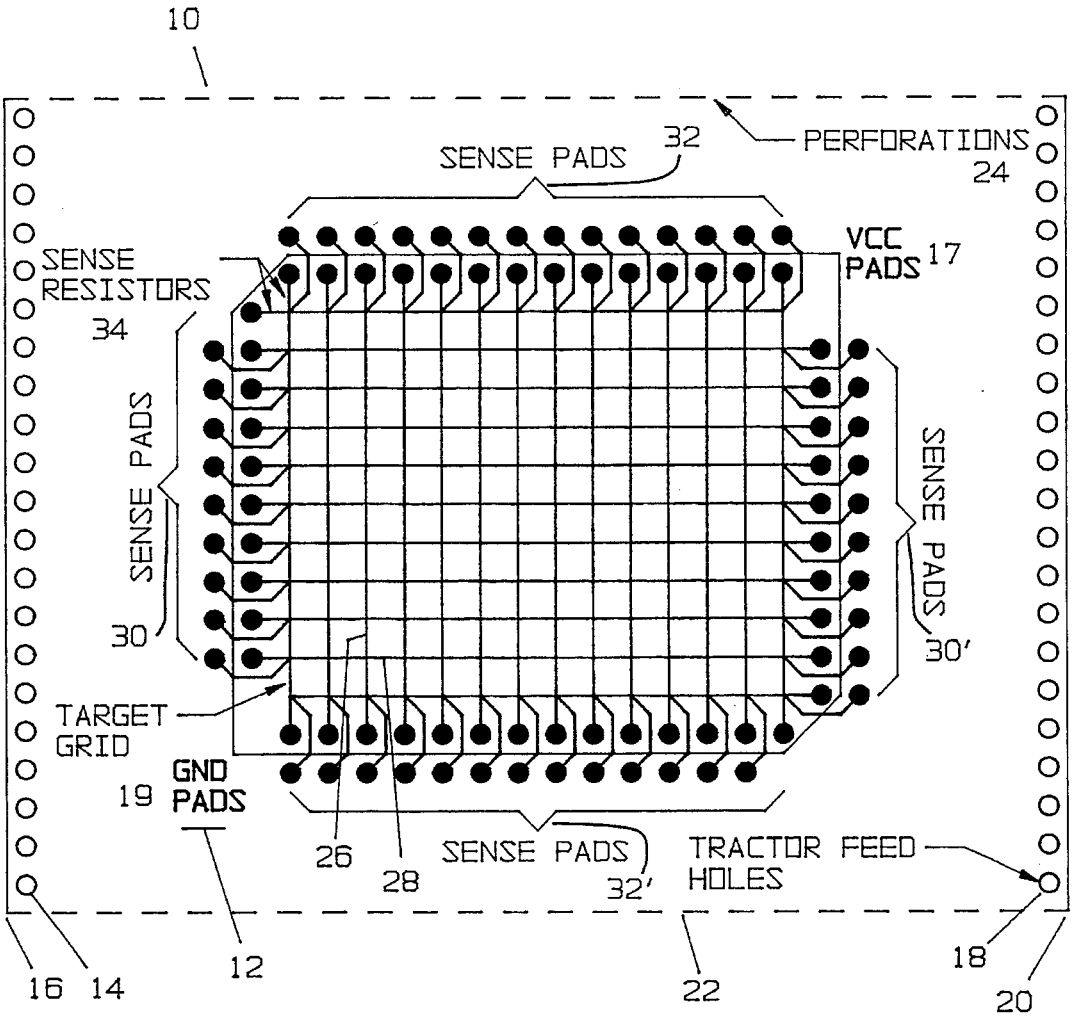
FIG. 1 is a graphic illustration of a target layout grid of the instant invention placed upon tractor feed paper.

Now referring to the FIG. 1, shown is a graphic illustration of the target 10 used in the invention. The target is formed from a roll, or fan-fold stack, of continuous paper 12 having two side surfaces with a series of pin holes 14 and 18 along each side edge 16 and 20, respectively, Spacing of pin holes are relatively equal to drive-pin placement of a conventional tractor-feed delivery device, not shown, with perforations 22 and 24 placed across a horizontal width of the paper 12 connecting each side edge, for ease of separating the paper 12 into individual target sheets.

A matrix grid is formed by placement of conductive ink having a graphite colloidal suspension coating providing a consistent resistance along parallel, spaced -part vertical lines 26, approximately one eighth of an inch apart. In addition, the conductive ink forms parallel, spaced-apart horizontal lines 28, whereby the grid lines overlap at intersections, or nodes, creating an electrically-coupled interface. The ink includes the use of carbon, or the like, linearly resistive/conductive material providing the aforementioned, consistent resistance. It should be noted that resolution of detection can be varied by the distance between the lines. Furthermore, the grid need not be horizontal and vertical, and may be made of a triangular, or the like, shape having a linear current shift between two points when a portion of the conductive ink is removed.

The end-points 30, 30' of each horizontal ink-line and 32, 32' of each vertical ink-line end in forming sense pads which are coupled to the high-speed analog multiplier. Sense pads are used to measure the grid's activity. End points 17 are connected to the positive supply voltage (10 V). End-points 19 are connected to the negative supply voltage (GND). End-points 17 and 19 are used to excite the grid.

Figure 2:
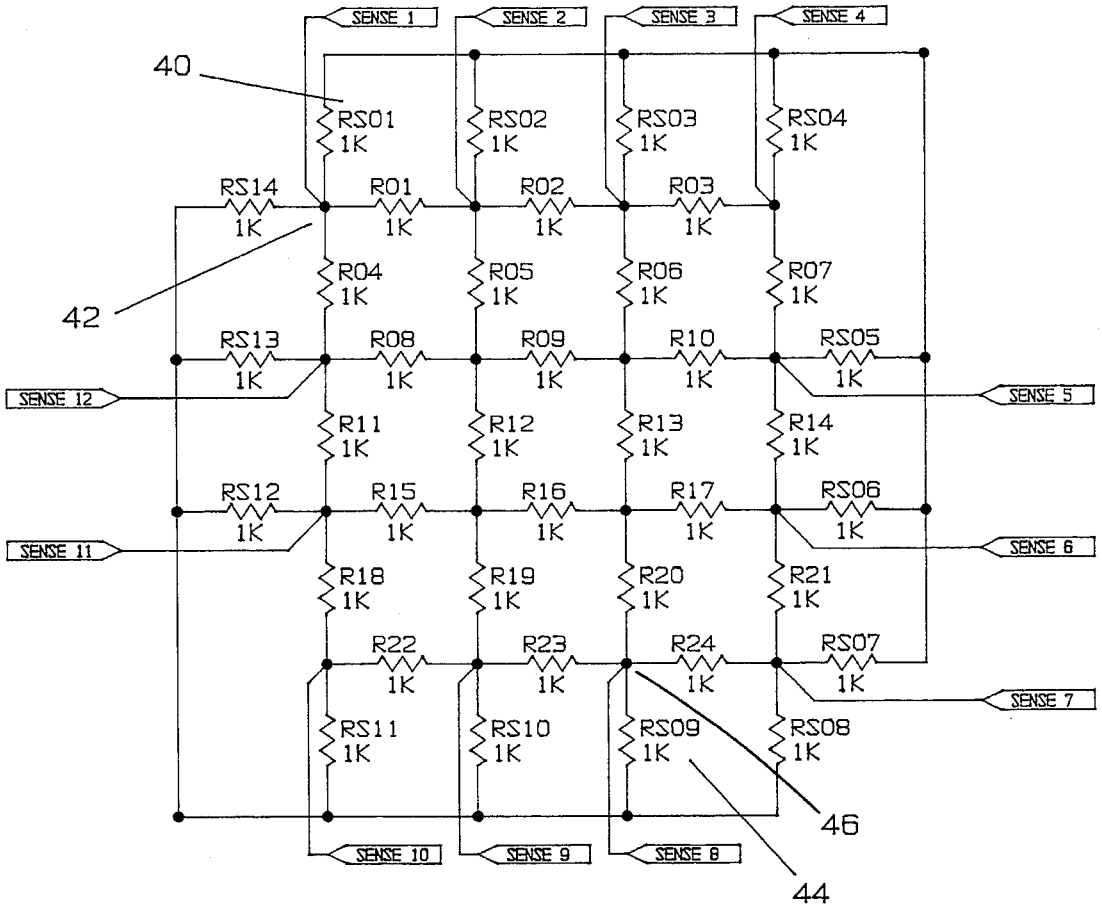
FIG. 2 is an electrical schematic of a resistor matrix model for the target grid.

Referring to FIG. 2, the overlapping vertical and horizontal lines create a resistive matrix. Resistors RS1 through RS14 are sense-resistors, in that they are used only to sense the current passing through their attached nodes. Thus, RS01, depicted by numeral 40, is attached to node 1, depicted by numeral 42. Resistor RS9, depicted by numeral 44, is attached to node 15, depicted by numeral 46. Resistors R1 through R24 are considered the target-resistors, in that they are located in a path of possible removal by the projectile. When a bullet, or other projectile, penetrates the grid, it will remove a section of the paper and associated ink, causing a loss of the target-resistor. The loss will result in a current shift in the grid, since the sense-resistors will, thus, have a fluctuation of current passing through them, because of the loss of one or more target-resistors. This fluctuation will cause a different voltage drop in the sense-resistors, which voltage-drop can be measured and converted into a digital format for subsequent analysis. A larger target is possible by increasing the size of the grid, with the accuracy remaining dependent upon the line spacing. It is noted that the sensing resistors RS01–RS14 are to be protected beneath a hardened steel fixture, so as to prevent destruction during the target shooting period.

In operation, voltage VCC is applied to the grid as depicted by numeral 17, and the other side of the grid is grounded as depicted by reference numeral 19, resulting in a current equalization to a predetermined, preset, calculable value. The resistive matrix model of FIG. 2 can be simulated by a nodal matrix 4× 4, which may be solved by the well-known, Gauss-Jordan numerical analysis reduction technique, which is used in the present invention to provide a "Successive Approximation Simulation", constituting part of the invention. In essence, the system of the invention simulates all possible combinations of resistors being removed from the matrix and compares that simulated value with the actual value being returned from the target until the differences become minimal. Upon this process, the simulator has discovered where the bullet penetrated the grid. Once the grid has been hit, the simulator uses the new grid as its new starting point or reference frame, so as to look for the next penetrating projectile.

The following chart I is the Pspice simulation circuit file that represents the schematic shown in FIG. 2, and is used to build the look-up table necessary to find the first missing resistor.

CHART I

| Pspice Simulation Circuit File | | | |
|---|---|---|---|
| VCC | VCC | 0 | |
| RS01 | VCC | 01 | 1K |
| RS02 | VCC | 02 | 1K |
| RS03 | VCC | 03 | 1K |
| RS04 | VCC | 04 | 1K |
| RS05 | 08 | VCC | 1K |
| RS06 | 12 | VCC | 1K |
| RS07 | 16 | VCC | 1K |
| RS08 | 16 | 0 | 1K |
| RS09 | 15 | 0 | 1K |
| RS10 | 14 | 0 | 1K |
| RS11 | 13 | 0 | 1K |

CHART I-continued

Pspice Simulation Circuit File

```
RS12 0    09   1K
RS13 0    05   1K
RS14 0    01   1K
R01  01   02   1K
R02  02   03   1K
R03  03   04   1K
R04  01   05   1K
R05  02   06   1K
R06  03   07   1K
R07  04   08   1K
R08  05   06   1K
R09  06   07   1K
R10  07   08   1K
R11  05   09   1K
R12  06   10   1K
R13  07   11   1K
R14  08   12   1K
R15  09   10   1K
R16  10   11   1K
R17  11   12   1K
R18  09   13   1K
R19  10   14   1K
R20  11   15   1K
R21  12   16   1K
R22  13   14   1K
R23  14   15   1K
R24  15   16   1K
.DC  VCC  0  10  10
.PRINT DC   V(01)  V(02)  V(03)  V(04)  V(08)  V(12)
.PRINT DC   V(16)  V(15)  V(14)  V(13)  V(09)  V(05)
.END
```

Charts I and III set forth the matrix definition and resistor simulation data file used to load all the matrix parameter data into the software analysis program, which program is listed separately hereinbelow. Chart II is the Nodal Matrix that has been derived using Kirchhoff's current law. The diagonal numbers (4 or 3) represent the number of resistors attached to that node and the −1's represent the adjacent node attached to that node via a resistor. For example, node 6 has 4 resistors attached to it R5, R8, R9, and R12 which are attached to nodes 2, 5, 7, and 10, respectively. Therefore a −1 is placed in the respective columns. The row that contains a ten below the nodes that have a resistor attached to VCC (10 VDC), and a zero for the nodes that have a resistor attached to GND (OVDC) is the matrix constant. These arrays Shown in Chart II are used to simulate what will happen when a resistor is removed, as when hit by a bullet, or the like. Once the Gauss-Jordan reduction process has been performed, the solution to the sense voltages is generated. The Resistor Nodes is a list of all the resistor designations along with their attached node designations. For example, resistor number 12 is attached to both nodes 6 and 10. The Node Resistors (Chart III) is a list of all the nodes and the resistor designations that are attached to that node. For example, node 11 has resistors 13, 16, 17 and 20 attached to it. The Resistor Nodes and the Node Resistor sets are used in the graph as an algorithm to determine the next possible missing resistor when multiple resistors have been removed from the grid.

Chart IV shows an example of the initial verify matrix file generated and used as the reference chart for simulating the system to find the missing resistor or resistors. Chart V shows the results of the simulation program The values shown in Charts II–IV are by way of example only, and do not necessarily represent the actual numbers generated for one grid with 24 resistors in actual use, nor are the charts necessarily directed to the same resistive values of resistors used. These charts are given only as by way of example.

CHART II

Matrix Definition and Resistor Simulation data file

Nodal Matrix 4 × 4

| | 01 | 02 | 03 | 04 | 05 | 06 | 07 | 08 | 09 | 10 | 11 | 12 | 13 | 14 | 15 | 16 |
|---|---|---|---|---|---|---|---|---|---|---|---|---|---|---|---|---|
| 01 | 4 | −1 | 0 | 0 | −1 | 0 | 0 | 0 | 0 | 0 | 0 | 0 | 0 | 0 | 0 | 0 |
| 02 | −1 | 4 | −1 | 0 | 0 | −1 | 0 | 0 | 0 | 0 | 0 | 0 | 0 | 0 | 0 | 0 |
| 03 | 0 | −1 | 4 | −1 | 0 | 0 | −1 | 0 | 0 | 0 | 0 | 0 | 0 | 0 | 0 | 0 |
| 04 | 0 | 0 | −1 | 3 | 0 | 0 | 0 | −1 | 0 | 0 | 0 | 0 | 0 | 0 | 0 | 0 |
| 05 | −1 | 0 | 0 | 0 | 4 | −1 | 0 | 0 | −1 | 0 | 0 | 0 | 0 | 0 | 0 | 0 |
| 06 | 0 | −1 | 0 | 0 | −1 | 4 | −1 | 0 | 0 | −1 | 0 | 0 | 0 | 0 | 0 | 0 |
| 07 | 0 | 0 | −1 | 0 | 0 | −1 | 4 | −1 | 0 | 0 | −1 | 0 | 0 | 0 | 0 | 0 |
| 08 | 0 | 0 | 0 | −1 | 0 | 0 | −1 | 4 | 0 | 0 | 0 | −1 | 0 | 0 | 0 | 0 |
| 09 | 0 | 0 | 0 | 0 | −1 | 0 | 0 | 0 | 4 | −1 | 0 | 0 | −1 | 0 | 0 | 0 |
| 10 | 0 | 0 | 0 | 0 | 0 | −1 | 0 | 0 | −1 | 4 | −1 | 0 | 0 | −1 | 0 | 0 |
| 11 | 0 | 0 | 0 | 0 | 0 | 0 | −1 | 0 | 0 | −1 | 4 | −1 | 0 | 0 | −1 | 0 |
| 12 | 0 | 0 | 0 | 0 | 0 | 0 | 0 | −1 | 0 | 0 | −1 | 4 | 0 | 0 | 0 | −1 |
| 13 | 0 | 0 | 0 | 0 | 0 | 0 | 0 | 0 | −1 | 0 | 0 | 0 | 3 | −1 | 0 | 0 |
| 14 | 0 | 0 | 0 | 0 | 0 | 0 | 0 | 0 | 0 | −1 | 0 | 0 | −1 | 4 | −1 | 0 |
| 15 | 0 | 0 | 0 | 0 | 0 | 0 | 0 | 0 | 0 | 0 | −1 | 0 | 0 | −1 | 4 | −1 |
| 16 | 0 | 0 | 0 | 0 | 0 | 0 | 0 | 0 | 0 | 0 | 0 | −1 | 0 | 0 | −1 | 4 |

Matrix Constants

| | | | | | | | | | | | | | | | |
|---|---|---|---|---|---|---|---|---|---|---|---|---|---|---|---|
| 10 | 10 | 10 | 10 | 0 | 0 | 0 | 10 | 0 | 0 | 0 | 10 | 0 | 0 | 0 | 10 |

Resistor Nodes

| | | | |
|---|---|---|---|
| Res | 01 | 01 | 02 |
| Res | 02 | 02 | 03 |
| Res | 03 | 03 | 04 |
| Res | 04 | 01 | 05 |
| Res | 05 | 02 | 06 |
| Res | 06 | 03 | 07 |

CHART II-continued

| Matrix Definition and Resistor Simulation data file | | | |
|---|---|---|---|
| Res | 07 | 04 | 08 |
| Res | 08 | 05 | 06 |
| Res | 09 | 06 | 07 |
| Res | 10 | 07 | 08 |
| Res | 11 | 05 | 09 |
| Res | 12 | 06 | 10 |
| Res | 13 | 07 | 11 |
| Res | 14 | 08 | 12 |
| Res | 15 | 09 | 10 |
| Res | 16 | 10 | 11 |
| Res | 17 | 11 | 12 |
| Res | 18 | 09 | 13 |
| Res | 19 | 10 | 14 |
| Res | 20 | 11 | 15 |
| Res | 21 | 12 | 16 |
| Res | 22 | 13 | 14 |
| Res | 23 | 14 | 15 |
| Res | 24 | 15 | 16 |

CHART III

| Node Resistors | | | | | |
|---|---|---|---|---|---|
| Node | 01 | 01 | 04 | | |
| Node | 02 | 01 | 02 | 05 | |
| Node | 03 | 02 | 03 | 06 | |
| Node | 04 | 03 | 07 | | |
| Node | 05 | 04 | 08 | 11 | |
| Node | 06 | 05 | 08 | 09 | 12 |
| Node | 07 | 06 | 09 | 10 | 13 |
| Node | 08 | 07 | 10 | 14 | |
| Node | 09 | 11 | 15 | 18 | |
| Node | 10 | 12 | 15 | 16 | 19 |
| Node | 11 | 13 | 16 | 17 | 20 |
| Node | 12 | 14 | 17 | 21 | |
| Node | 13 | 18 | 22 | | |
| Node | 14 | 19 | 22 | 23 | |
| Node | 15 | 20 | 23 | 24 | |
| Node | 16 | 21 | 24 | | |

| | | Sense Resistor Voltages | | | | | | | | | | | |
|---|---|---|---|---|---|---|---|---|---|---|---|---|---|
| | | 01 | 02 | 03 | 04 | 05 | 06 | 07 | 08 | 09 | 10 | 11 | 12 |
| Res | 00 | 5.000 | 7.016 | 8.065 | 8.710 | 8.065 | 7.016 | 5.000 | 2.984 | 1.935 | 1.290 | 1.935 | 2.984 |
| Res | 01 | 4.290 | 7.869 | 8.355 | 8.836 | 8.154 | 7.067 | 5.022 | 3.021 | 1.971 | 1.301 | 1.933 | 2.869 |
| Res | 04 | 5.710 | 7.131 | 8.067 | 8.699 | 8.029 | 6.979 | 4.978 | 2.933 | 1.846 | 1.164 | 1.645 | 2.131 |
| Res | 02 | 4.879 | 6.594 | 8.511 | 8.885 | 8.145 | 7.047 | 5.010 | 2.993 | 1.929 | 1.281 | 1.912 | 2.923 |
| Res | 05 | 5.121 | 7.767 | 8.179 | 8.716 | 7.969 | 6.925 | 4.951 | 2.878 | 1.783 | 1.176 | 1.743 | 2.719 |
| Res | 03 | 4.973 | 6.931 | 7.800 | 9.071 | 8.143 | 7.032 | 5.002 | 2.977 | 1.926 | 1.283 | 1.923 | 2.962 |
| Res | 06 | 5.005 | 7.108 | 8.651 | 8.843 | 7.879 | 6.883 | 4.940 | 2.877 | 1.855 | 1.239 | 1.863 | 2.912 |
| Res | 07 | 5.002 | 7.032 | 8.143 | 9.071 | 7.800 | 6.931 | 4.973 | 2.962 | 1.923 | 1.283 | 1.926 | 2.977 |
| Res | 08 | 4.879 | 7.281 | 8.257 | 8.824 | 8.217 | 7.122 | 5.049 | 3.075 | 2.031 | 1.284 | 1.821 | 2.233 |
| Res | 11 | 5.121 | 7.077 | 8.088 | 8.719 | 8.071 | 7.007 | 4.990 | 2.953 | 1.855 | 1.115 | 1.489 | 3.406 |
| Res | 09 | 4.905 | 6.862 | 8.236 | 8.846 | 8.303 | 7.128 | 5.038 | 3.025 | 1.890 | 1.238 | 1.824 | 2.759 |
| Res | 12 | 5.095 | 7.241 | 8.176 | 8.762 | 8.110 | 6.975 | 4.962 | 2.872 | 1.697 | 1.154 | 1.764 | 3.138 |
| Res | 10 | 4.940 | 6.883 | 7.879 | 8.843 | 8.651 | 7.108 | 5.005 | 2.912 | 1.863 | 1.239 | 1.855 | 2.877 |
| Res | 13 | 5.038 | 7.128 | 8.303 | 8.846 | 8.236 | 6.862 | 4.905 | 2.759 | 1.824 | 1.238 | 1.890 | 3.025 |
| Res | 14 | 5.010 | 7.047 | 8.145 | 8.885 | 8.511 | 6.594 | 4.879 | 2.923 | 1.912 | 1.281 | 1.929 | 2.993 |
| Res | 15 | 4.995 | 7.088 | 8.137 | 8.761 | 8.145 | 7.123 | 5.060 | 3.117 | 2.121 | 1.157 | 1.349 | 2.892 |
| Res | 18 | 5.027 | 7.038 | 8.077 | 8.717 | 8.074 | 7.023 | 4.998 | 2.968 | 1.857 | 0.929 | 2.200 | 3.069 |
| Res | 16 | 4.962 | 6.975 | 8.110 | 8.762 | 8.176 | 7.241 | 5.095 | 3.138 | 1.764 | 1.154 | 1.697 | 2.872 |
| Res | 19 | 5.060 | 7.123 | 8.145 | 8.761 | 8.137 | 7.088 | 4.995 | 2.892 | 1.349 | 1.157 | 2.121 | 3.117 |
| Res | 17 | 4.951 | 6.925 | 7.969 | 8.716 | 8.179 | 7.767 | 5.121 | 2.719 | 1.743 | 1.176 | 1.783 | 2.878 |
| Res | 20 | 5.049 | 7.122 | 8.217 | 8.824 | 8.257 | 7.281 | 4.879 | 2.233 | 1.821 | 1.284 | 2.031 | 3.075 |
| Res | 21 | 5.022 | 7.067 | 8.154 | 8.836 | 8.355 | 7.869 | 4.290 | 2.869 | 1.933 | 1.301 | 1.971 | 3.021 |
| Res | 21 | 4.998 | 7.023 | 8.074 | 8.717 | 8.077 | 7.038 | 5.027 | 3.069 | 2.200 | 0.929 | 1.857 | 2.968 |
| Res | 23 | 4.990 | 7.007 | 8.071 | 8.719 | 8.088 | 7.077 | 5.121 | 3.406 | 1.489 | 1.115 | 1.855 | 2.953 |
| Res | 24 | 4.978 | 6.979 | 8.029 | 8.699 | 8.067 | 7.131 | 5.710 | 2.131 | 1.645 | 1.164 | 1.846 | 2.933 |

CHART IV

| Verify Matrix File | | | | | | | | | | | | |
|---|---|---|---|---|---|---|---|---|---|---|---|---|
| 5.000, | 7.016, | 8.065, | 8.710, | 8.065, | 7.016, | 5.000, | 2.984, | 1.935, | 1.290, | 1.935, | 2.984, | R00 |
| 4.290, | 7.869, | 8.355, | 8.836, | 8.154, | 7.067, | 5.022, | 3.021, | 1.971, | 1.301, | 1.933, | 2.869, | R01 |
| 4.879, | 6.594, | 8.511, | 8.885, | 8.145, | 7.047, | 5.010, | 2.993, | 1.929, | 1.281, | 1.912, | 2.923, | R02 |
| 4.973, | 6.931, | 7.800, | 9.072, | 8.143, | 7.032, | 5.002, | 2.977, | 1.926, | 1.283, | 1.923, | 2.962, | R03 |
| 5.710, | 7.131, | 8.067, | 8.699, | 8.029, | 6.979, | 4.978, | 2.933, | 1.846, | 1.164, | 1.645, | 2.131, | R04 |
| 5.121, | 7.767, | 8.179, | 8.716, | 7.969, | 6.925, | 4.951, | 2.878, | 1.783, | 1.176, | 1.743, | 2.719, | R05 |
| 5.005, | 7.108, | 8.651, | 8.843, | 7.879, | 6.883, | 4.940, | 2.877, | 1.855, | 1.239, | 1.863, | 2.912, | R06 |
| 5.002, | 7.032, | 8.143, | 9.072, | 7.800, | 6.931, | 4.973, | 2.962, | 1.923, | 1.283, | 1.926, | 2.977, | R07 |
| 4.879, | 7.281, | 8.257, | 8.824, | 8.217, | 7.122, | 5.049, | 3.075, | 2.031, | 1.284, | 1.821, | 2.233, | R08 |
| 4.905, | 6.862, | 8.236, | 8.847, | 8.303, | 7.128, | 5,038, | 3.025, | 1.890, | 1.238, | 1.824, | 2.759, | R09 |
| 4.940, | 6.883, | 7.879, | 8.843, | 8.651, | 7.108, | 5.005, | 2.912, | 1.863, | 1.239, | 1.855, | 2.877, | R10 |
| 5.121, | 7.077, | 8.088, | 8.719, | 8.071, | 7.007, | 4.990, | 2.953, | 1.855, | 1.115, | 1.489, | 3.406, | R11 |
| 5.095, | 7.241, | 8.176, | 8.762, | 8.110, | 6.975, | 4.962, | 2.872, | 1.697, | 1.154, | 1.764, | 3.138, | R12 |
| 5.038, | 7.128, | 8.303, | 8.847, | 8.236, | 6.862, | 4.905, | 2.759, | 1.824, | 1.238, | 1.890, | 3.025, | R13 |
| 5.010, | 7.047, | 8.145, | 8.885, | 8.511, | 5.594, | 4.879, | 2.923, | 1.912, | 1.281, | 1.929, | 2.993, | R14 |
| 4.995, | 7.088, | 8.137, | 8.761, | 8.145, | 7.123, | 5.060, | 3.117, | 2.121, | 1.157, | 1.349, | 2.892, | R15 |
| 4.962, | 6.975, | 8.110, | 8.762, | 8.176, | 7.241, | 5.095, | 3.138, | 1.764, | 1.154, | 1.697, | 2.872, | R16 |
| 4.951, | 6.925, | 7.969, | 8.716, | 8.179, | 7.767, | 5.121, | 2.719, | 1.743, | 1.176, | 1.783, | 2.878, | R17 |
| 5.027, | 7.038, | 8.077, | 8.717, | 8.074, | 7.023, | 4.998, | 2.968, | 1.857, | 0.928, | 2.200, | 3.069, | R18 |
| 5.060, | 7.123, | 8.145, | 8.761, | 8.137, | 7.088, | 4.995, | 2.892, | 1.349, | 1.157, | 2.121, | 3.117, | R19 |
| 5.049, | 7.122, | 8.217, | 8.824, | 8.257, | 7.281, | 4.879, | 2.233, | 1.821, | 1.284, | 2.031, | 3.075, | R20 |
| 5.022, | 7.067, | 8.154, | 8.836, | 8.355, | 7.869, | 4.290, | 2.869, | 1.933, | 1.301, | 1.971, | 3.021, | R21 |
| 4.998, | 7.023, | 8.074, | 8.717, | 8.077, | 7.038, | 5.027, | 3.069, | 2.200, | 0.928, | 1.857, | 2.968, | R22 |
| 4.990, | 7.007, | 8.071, | 8.719, | 8.088, | 7.077, | 5.121, | 3.406, | 1.489, | 1.115, | 1.855, | 2.953, | R23 |
| 4.978, | 6.979, | 8.029, | 8.699, | 8.067, | 7.131, | 5.710, | 2.131, | 1.645, | 1.164, | 1.846, | 2.933, | R24 |
| 5.060, | 7.530, | 8.366, | 8.792, | 8.011, | 6.945, | 4.959, | 2.890, | 1.791, | 1.179, | 1.747, | 2.711, | R02&R05 |
| 4.984, | 7.002, | 8.106, | 8.911, | 8.627, | 6.969, | 4.933, | 2.762, | 1.798, | 1.213, | 1.842, | 2.936, | R10&R13 |
| 5.004, | 7.092, | 8.138, | 8.761, | 8.145, | 7.121, | 5.057, | 3.106, | 2.087, | 1.044, | 1.462, | 2.923, | R15&R18 |
| 5.039, | 7.114, | 8.231, | 8.858, | 8.343, | 7.561, | 5.854, | 0.676, | 1.351, | 1.098, | 1.943, | 3.042, | R20&R24 |
| 5.000, | 7.839, | 8.517, | 8.948, | 8.328, | 7.082, | 5.000, | 2.918, | 1.672, | 1.052, | 1.483, | 2.161, | |
| R05&R08&R09&R12 | | | | | | | | | | | | |
| 5.000, | 7.082, | 8.328, | 8.948, | 8.517, | 7.839, | 5.000, | 2.161, | 1.483, | 1.052, | 1.672, | 2.918, | |
| R13&R16&R17&R20 | | | | | | | | | | | | |

CHART V

| Results printed from the Matrix Analysis Program |
|---|
| Verified Matrix . . . |
| Removed = R01 → Found = R01 |
| Removed = R02 → Found = R02 |
| Removed = R03 → Found = R03 |
| Removed = R04 → Found = R04 |
| Removed = R05 → Found = R05 |
| Removed = R06 → Found = R06 |
| Removed = R07 → Found = R07 |
| Removed = R08 → Found = R08 |
| Removed = R09 → Found = R09 |
| Removed = R10 → Found = R10 |
| Removed = R11 → Found = R11 |
| Removed = R12 → Found = R12 |
| Removed = R13 → Found = R13 |
| Removed = R14 → Found = R14 |
| Removed = R15 → Found = R15 |
| Removed = R16 → Found = R16 |
| Removed = R17 → Found = R17 |
| Removed = R18 → Found = R18 |
| Removed = R19 → Found = R19 |
| Removed = R20 → Found = R20 |
| Removed = R21 → Found = R21 |
| Removed = R22 → Found = R22 |
| Removed = R23 → Found = R23 |
| Removed = R24 → Found = R24 |
| Removed = R02&R05 → Found = R02 & R05 |
| Removed = R10&R13 → Found = R10 & R13 |
| Removed = R15&R18 → Found = R15 & R18 |
| Removed = R20&R24 → Found = R20 & R24 |
| Removed = R05&R08&R09&R12 → Found = R05 & R08 & R09 |
| Removed = R13&R16&R17&R20 → Found = R13 & R16 & R17 |

Figure 3:
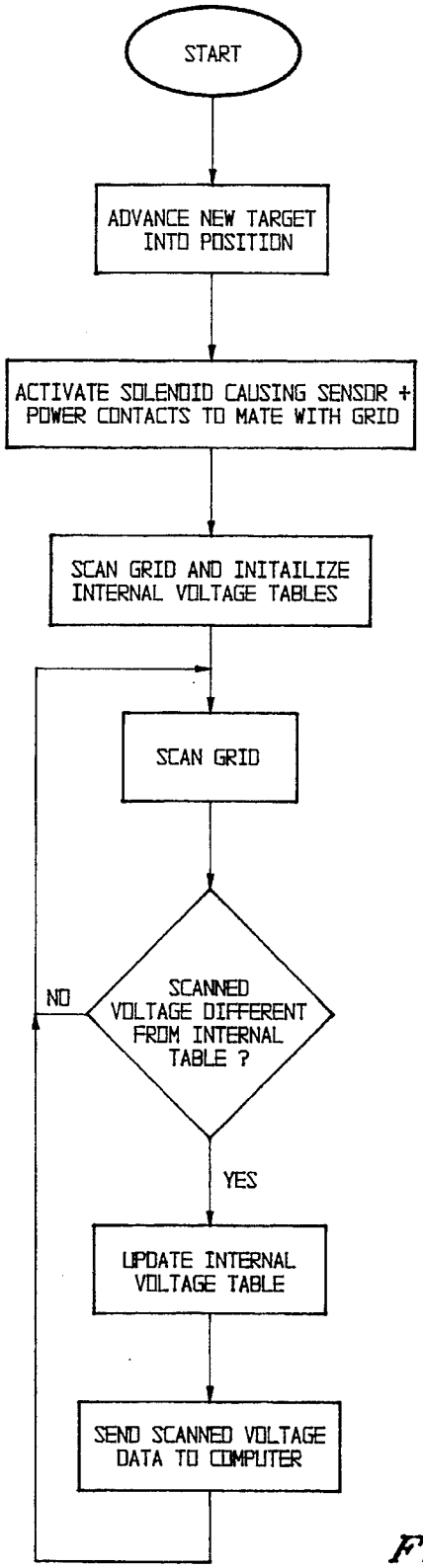
FIG. 3 is a target sequence flow chart.
Figure 6:
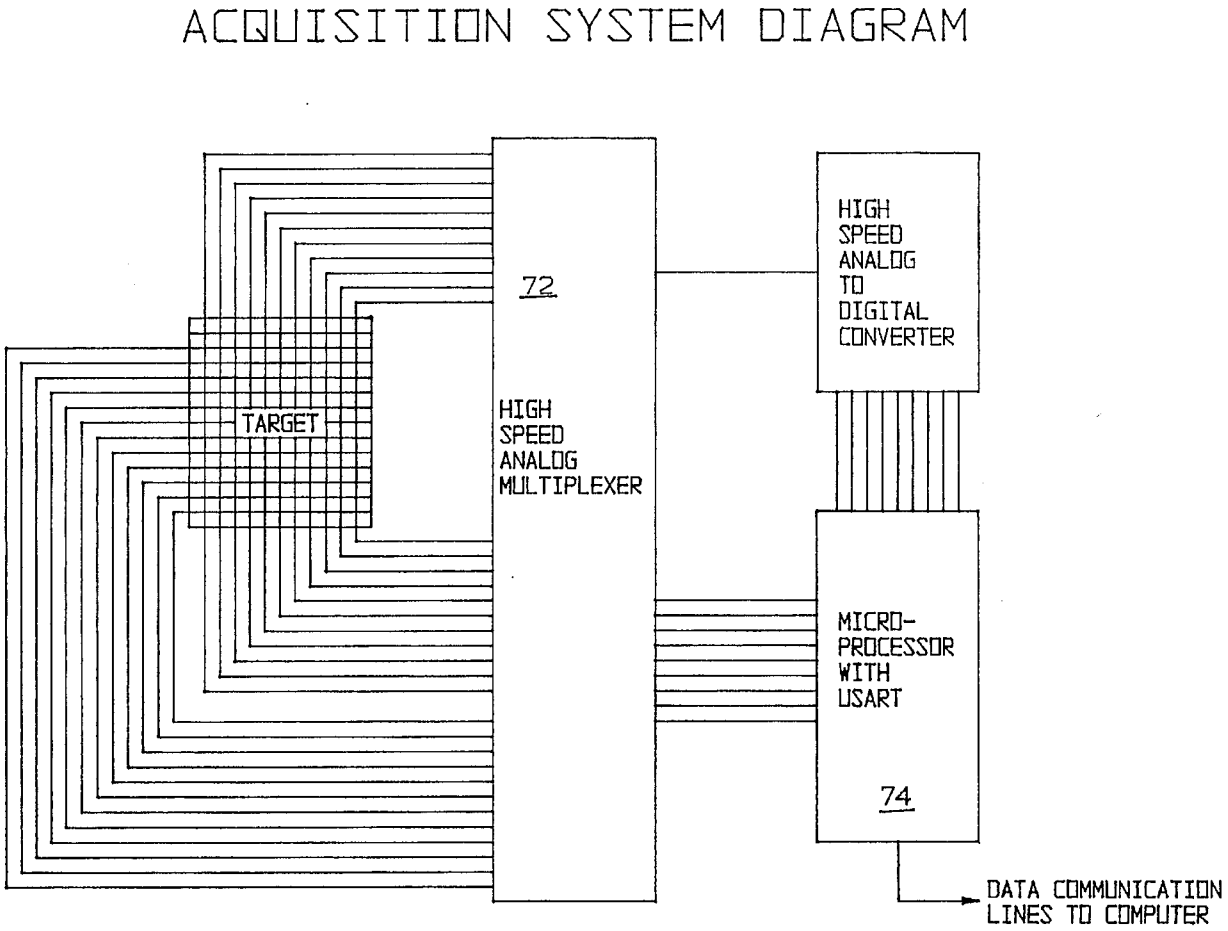
FIG. 6 is a block diagram of the system hardware of the invention.

Now referring to FIG. 3, shown is a sequence flow chart wherein a target is advanced into position 50 by moving the tractor feed paper until a registered mark is detected, in a well-known manner. Once the mark is detected, the paper is stopped and a solenoid activates, causing contacts to mate with the sense pads and power pads. The grid is initially scanned and initialized to generate internal voltage tables by use of a high speed analog multiplexer 72 (FIG. 6) that samples each sense-voltage and stores its value in the look-up table of the memory associated with microprocessor 74 (FIG. 6). This sampling continues and is compared with memory continually 54, until a change in the sense-voltages occurs. Once a change has occurred, the internal table 58 is then modified in memory to reflect new sense-voltages for sending forth the information to the microprocessor 74 that can display to the user where the target was hit 60. The system then resumes scanning until the next bullet disturbs the grid, with the last stored values now serving as the new reference.

Figure 4:
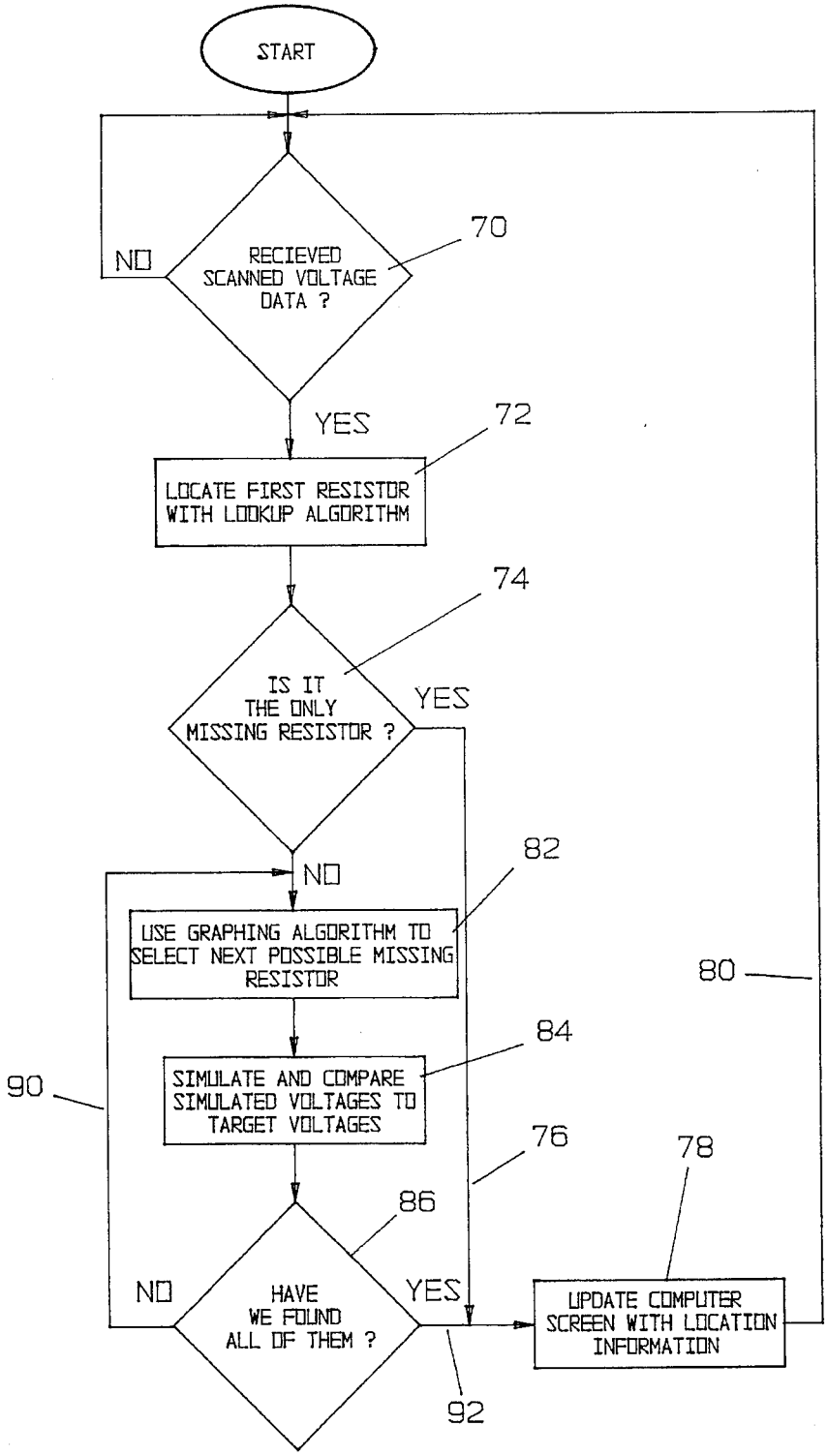
FIG. 4 is the computer target analysis flow chart.

Now referring to FIG. 4, shown is a flow schematic of the computer target analysis flow chart wherein the decision is first determined whether a scanned voltage data 70 is received from the target microprocessor. Once received, the analysis program with microprocessor 74 detects the first missing resistor 72 to determine if it is the only resistor missing. If as it is the only resistor missing, the computer screen is updated with the information and the system returns into a scanning position 80. If another resistor is determined missing, then the analysis program 82 determines what the next possible missing resistor is available and simulates and compares the voltages to target voltages 84 to determine if all the resistors destroyed have been located. If not, the system returns 90 to select the next possible missing resistor. Once all the resistors have been located, the system 92 is updated 78 and returned back to the scanning position 80 for receipt of additional voltage data.

Figure 5:
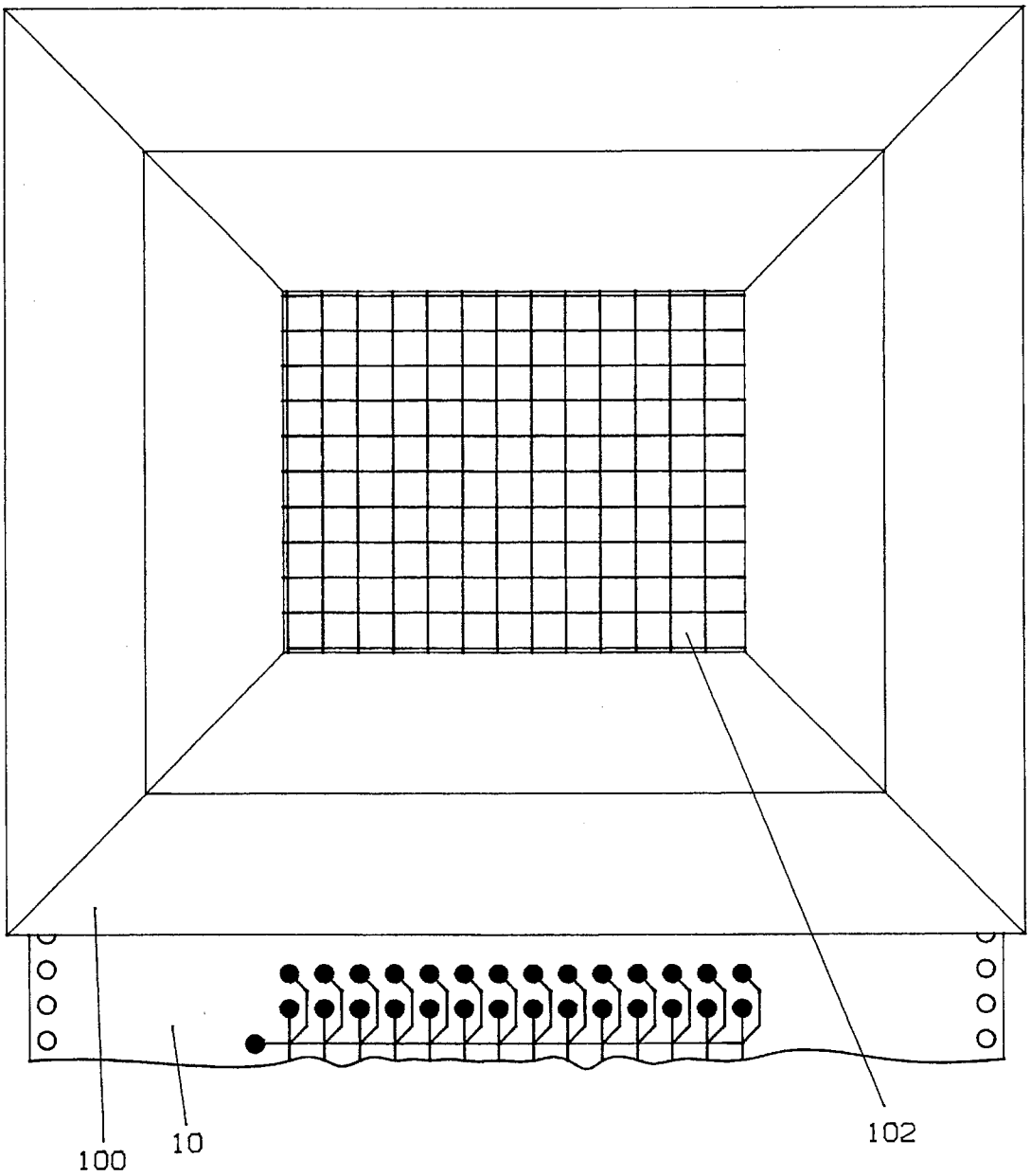
FIG. 5 is a graphic model of target face.

Now referring to FIG. 5, there is shown a pictorial view of the invention 10 having a sensing grid cover 100 to shield the sensing resistors from damage. The grid surface 102 can be covered with a silk-screened image of any type of target dependent upon the needs of the sporting event or law enforcement personnel.

While a grid system has been shown and described, the same concept of the invention is equally applicable to any conductive surface whose resistive value will change upon losing a section or sections thereof, as long as the there is a linear current shift upon the loss of the section or sections, or modifying their resistance as with strain gauges, which, therefore, allows for the numerical analysis of the software of the invention (which is based on the Gauss-Jordon linear numerical analysis technique) to calculate the most probable one of the section or sections that has been removed based on that linear current shift. For example, the system of the invention has equally-applicable use in a computer screen for use in a stylus or touch-screen system, whereupon touching a certain section of the screen, the resistance thereat will be modified:or temporarily altered.

It is to be understood that while I have illustrated and described certain forms of my invention, it is not to be limited to specific forms or arrangement of parts herein described and shown. It will be apparent to those skilled in the art that various changes may be made without departing from the scope of the invention and the invention is not to be considered limited to what is shown in the drawings and described in the specification. For example, instead of an matrix array of resistors, a matrix array of transistors, and the like may be used, where some transistors are sense-transistors and some are target, or main, transistors.

The target analysis software program that is used to Verify the operation of the system by reading the verify matrix file and for locating the missing resistor or resistors based strictly on the sense voltages, is listed hereinbelow.

Target Analysis program

```
/* Target.c
   Written by Bruce Hodge Not to be copied without written permission...
*/

#include <math.h>
#include <alloc.h>
#include <stdio.h>
#include <string.h>
#include <conio.h>
#include <stdlib.h>
#include "rtstdhdr.h"
#include "rtcurvef.h"

#define DEBUG
#define Xwidth        4
#define Ywidth        4
#define MaxCPerR      2
#define MaxRPerC      4
#define MatrixSize    Xwidth*Ywidth
#define MaxNodes      MatrixSize
#define MaxRes        Xwidth*Ywidth*MaxCPerR-(Xwidth+Ywidth)
#define MaxSense      (Xwidth*MaxCPerR)+((Ywidth-1)*MaxCPerR)-MaxCPerR
#define MaxElem       MatrixSize*MatrixSize
#define UsedElem      MatrixSize*MaxRPerC-MaxRPerC
#define DACRes        (10.0/256)

matstruct   x,inv,y,solution;
int error,start=0,Row,Col,NodeResistors[MaxRes+1][MaxRPerC]={0};
int seqstart=0,seqcnt=0,seqinc=0,seqflag=Xwidth,ResistorNodes[MaxRes+1][2]={0};
float Sense[MaxRes+1][MaxSense],Solution[MaxSense],CurrentSense[MaxSense];
char MatrixConstants[MatrixSize*5],MissingResistors[100];
realtype matdet;

FILE *fptr;

/* This code reads text until it hits a carrage return (one line at a time)*/
int read_line(char *buff)
{ int i=0;

     if(feof(fptr))return(0);
     do
     {
if(!fread(&buff[i],1,1,fptr))if(i==0)return(0);else{buff[i]='\0';return(1);}
     }while(buff[i++]!='\n');
     if(isspace(buff[i-2]))buff[i-2]='\0';else buff[--i]='\0';return(1);
}
```

```
/* This procedure Calulates the nodal matrix solution using GaussJordan
   reduction technique.
*/
void calcSolution()
{ int i,p=0,seq=0;
  char *token,buff[100];

  strcpy(buff,MatrixConstants);
  token=strtok(buff," ");
     for(i=0;i<MatrixSize;i++)
  { wrmat(&y,i,0,atof(token));token=strtok(NULL," ");}
     rtgaussjordan(&x,&y,MatrixSize,&solution,&inv,&matdet,&error);

/* This code calculates the sense resistor node voltages and stores them in
   the Solution array.
*/
     for(i=0;i<MaxSense;i++)
     { switch(seq)
          { case 0 : p++;if(p==Xwidth)seq++;break;
               case 1 : p+=Xwidth;if(p==MatrixSize)seq++;break;
               case 2 : p--;if(p==MatrixSize-Xwidth+1)seq++;break;
               case 3 : p-=Xwidth;break;
          }
          Solution[i]=rdmat(&solution,p-1,0);
     }
}

/* This procedure removes all the requested resistors then simulates the
   analog voltages. Next it calculates the delta difference between what
   was simulated and what was actually sensed from the target.

   rcnt is the # of resistors removed
   r is the resistor to remove
   v is a bitwise count value that is used to determine which resistors of
   r are to be removed
*/
float simulate(int v,int rcnt,int r[10])
{ float delta=0.0,r1,r2;
  int i,j,k,m=1,n[20][2],cnt=0;

/* Find all selected resistor nodes by shifting a 1 left and masking it with v
*/
  for(i=0;i<rcnt;i++)
  { if(v&m)
    { n[cnt][0]=ResistorNodes[r[i]][0];n[cnt++][1]=ResistorNodes[r[i]][1];}
    m<<=1;
  }
#ifdef Debug
  calcSolution();
#endif
```

```
  /* remove the resistors from nodal matrix */
  for(i=0;i<cnt;i++)
  { j=n[i][0]-1;k=n[i][1]-1;
    r1=rdmat(&x,j,j)-1.0;wrmat(&x,j,j,r1);
    r1=rdmat(&x,k,k)-1.0;wrmat(&x,k,k,r1);
    wrmat(&x,j,k,0.0);wrmat(&x,k,j,0.0);
  }
  calcSolution();

  /* replace the resistors */
  for(i=0;i<cnt;i++)
  { j=n[i][0]-1;k=n[i][1]-1;
    r1=rdmat(&x,j,j)+1.0;wrmat(&x,j,j,r1);
    r1=rdmat(&x,k,k)+1.0;wrmat(&x,k,k,r1);
    wrmat(&x,j,k,-1.0);wrmat(&x,k,j,-1.0);
  }
  delta=0.0;for(j=0;j<MaxSense;j++)delta+=fabs(CurrentSense[j]-Solution[j]);
  return(delta);
}

/* This procedure locates the missing resistors and returns their designation
   in buff.
*/
void findem(char *buff)
{ float delta,mindelta=10.0;
  int i,j,k,r=0,resistors[10],rcnt=0,found,max;
  char t[10];

/* Find the first missing resistor with straight linear lookup table and
   return if delta is less that .002.
*/
  for(i=0;i<=MaxRes;i++)
  { delta=0.0;
    for(j=0;j<MaxSense;j++)
    { delta+=fabs(CurrentSense[j]-Sense[i][j]);}
    if(delta<mindelta){ r=i;mindelta=delta;}
  }
  sprintf(buff,"R%02d",r);if(mindelta<0.002)return;

/* Figure out which resistors would be missing using a simple graphing
   technique and load them into the variable "resistors".
*/
  i=0;j=0;
  while(1)
  { found=0;
    for(k=0;k<rcnt;k++)
      if(NodeResistors[ResistorNodes[r][i]][j]==resistors[k])found=1;
    if(!found)
      resistors[rcnt++]=NodeResistors[ResistorNodes[r][i]][j++];
    else
      j++;
    if(NodeResistors[ResistorNodes[r][i]][j]==0 || j==4){ i++;j=0;}
    if(i==2)break;
```

```
/* Generate all possible sinarios of missing resistors with a counter and
   find out which permutation generates the smallest delta. That must be
   the missing resistors.
*/
  max=pow(2,rcnt);mindelta=10.0;
  for(i=1;i<max;i++)
  { delta=simulate(i,rcnt,resistors);
    if(delta<mindelta){ r=i;mindelta=delta;}
  }

/* Place the found resistors in buff and return.*/
  k=1;found=0;
  for(i=0;i<rcnt;i++)
  { if(k&r)
    { if(!found)
      { found=1;sprintf(buff,"R%02d ",resistors[i]);}
      else
      { sprintf(t,"& R%02d ",resistors[i]);strcat(buff,t);}
    }
    k<<=1;
  }
}

void main()
{ char buff[512],*token,*delimiter=" \t\r\n,";
  int i,j,k,err;
  float diffsum,f;

/* Allocate the memory needed to perform GaussJordan matrix reduction.
*/
     defmat(&x,MatrixSize,MatrixSize,&err);
     if(err){ printf("Matrix alloc error\n");exit(0);}
  defmat(&y,MatrixSize,1,&err);
     if(err){ printf("Matrix alloc error\n");exit(0);}
  defmat(&inv,MatrixSize,MatrixSize,&err);
     if(err){ printf("Matrix alloc error\n");exit(0);}
     defmat(&solution,MatrixSize,1,&err);
     if(err){ printf("Matrix alloc error\n");exit(0);}
     fptr=fopen("matrix.bld","r+b");
  if(fptr==NULL){ printf("Unable to open Matrix.bld...");exit(0);}

/* Load all the necessary matrix info into memory*/
  while(read_line(buff))
  { token=strtok(buff,delimiter);
    if(!strcmp(token,"Nodal"))
    { read_line(buff);
      for(i=0;i<MatrixSize;i++)
      { read_line(buff);token=strtok(buff,delimiter);
        for(j=0;j<MatrixSize;j++)
        { token=strtok(NULL,delimiter);
          wrmat(&x,i,j,atof(token));
        }
      }
```

```
  else if(!strcmp(token,"Matrix"))
  { read_line(MatrixConstants);
  }
  else if(!strcmp(token,"Resistor"))
  { for(i=1;i<=MaxRes;i++)
    { read_line(buff);token=strtok(buff,delimiter);
      if(strcmp(buff,"Res"))
      { printf("Error Reading Resistor Node %d",i);exit(0);}
      token=strtok(NULL,delimiter);j=atoi(token);
      token=strtok(NULL,delimiter);
      ResistorNodes[j][0]=atoi(token);
      token=strtok(NULL,delimiter);
      ResistorNodes[j][1]=atoi(token);
    }
  }
  else if(!strcmp(token,"Node"))
  { for(i=1;i<=MaxNodes;i++)
    { read_line(buff);token=strtok(buff,delimiter);
      if(strcmp(buff,"Node"))
      { printf("Error Reading Node Resistors %d",i);exit(0);}
      token=strtok(NULL,delimiter);j=atoi(token);
      token=strtok(NULL,delimiter);k=0;
      NodeResistors[j][k++]=atoi(token);
      token=strtok(NULL,delimiter);
      NodeResistors[j][k++]=atoi(token);
      token=strtok(NULL,delimiter);if(token==NULL)continue;
      NodeResistors[j][k++]=atoi(token);
      token=strtok(NULL,delimiter);if(token==NULL)continue;
      NodeResistors[j][k++]=atoi(token);
    }
  }
  else if(!strcmp(token,"Sense"))
  { read_line(buff);
    for(i=0;i<=MaxRes;i++)
    { read_line(buff);
      token=strtok(buff,delimiter);
      if(strcmp(buff,"Res"))
      { printf("Error Reading Sense Resistors %d",i);exit(0);}
      token=strtok(NULL,delimiter);j=atoi(token);
      for(k=0;k<MaxSense;k++)
      { token=strtok(NULL,delimiter);
        Sense[j][k]=atof(token);
      }
    }
  }
}
  fclose(fptr);
```

```
/* Load in the test file "Verify.mat" which contains actual data generated
   by Pspice analog simulator. These tables of voltages represent the sense
   voltages sensed by the target and this program should be able to locate
   the missing resistors based on these voltages.
*/
     fptr=fopen("Verify.mat","r+b");
  if(fptr==NULL){ printf("Unable to open Verify.Mat...");exit(0);}
  read_line(buff);
  token=strtok(buff,delimiter);diffsum=atof(token)-Sense[0][0];
  for(i=1;i<MaxSense;i++)
  { token=strtok(NULL,delimiter);diffsum+=atof(token)-Sense[0][i];}
  token=strtok(NULL,delimiter);
  if(strcmp(token,"R00"))
  { printf("Verify Failed Invalid Resistor number %s\n",token);exit(0);}
  if(fabs(diffsum)>.005)
  { printf("Verify Failed Error sum = %3.3f\n",diffsum);exit(0);}
  printf("Verified Matrix...\n");
  while(read_line(buff))
  { token=strtok(buff,delimiter);
    for(i=0;i<MaxSense;i++)
    { CurrentSense[i]=atof(token);token=strtok(NULL,delimiter);}
    strcpy(MissingResistors,token);
    while((token=strtok(NULL,delimiter))!=NULL)
    { strcat(MissingResistors," & ");strcat(MissingResistors,token);}
    findem(buff);printf("Removed = %s --> Found = %s\n",MissingResistors,buff);
  }
  fclose(fptr);
}
```

What is claimed is:

1. A location-determination apparatus comprising:

a surface having a matrix grid formed on at least one surface face thereof;

said matrix grid being formed from a plurality of parallel, spaced-apart horizontal and vertical conductive ink-lines, said horizontal and vertical ink-lines overlapping at nodes; each said horizontal and vertical ink-line comprising a plurality of sections, at least some of said sections being bounded by two said nodes, and at least one said section being bounded by one said node for providing a sense-parameter; each said node normally having an electrical parametric value associated therewith;

power means for providing current through said horizontal and vertical ink-lines in order to generate said electrical parametric value associated with each said node; and a computer simulation means operatively associated with said matrix grid for determination of the electrical parametric value at each said node, and for the detection of a loss of one or more said nodes by comparing said electrical parametric values of said nodes to said computer simulation.

2. The location-determination apparatus according to claim 1, wherein said electrical parametric value associated with each said node is resistance.

3. The location-determination apparatus according to claim 1, wherein said computer simulation means comprises a resistive matrix and a nodal matrix for solving by a matrix reduction technique.

4. The location-determination apparatus according to-claim 1, wherein said conductive ink is further defined as graphic colloidal suspension coating.

5. The location-determination apparatus according to claim 1, wherein said horizontal and vertical lines form a target with individual sensing circuits for measuring the resistance thereof and for detecting a loss of target-resistors indicative of a projectile striking said formed resistor.

6. The location-determination apparatus according to claim 5, wherein said computer simulator means is modified upon detection of a loss of a target-resistor and updated to reflect the current status of said matrix grid.

7. The location-determination apparatus according to claim 6, including a video display means for remote visual display of loss target-resistors.

8. The location-determination apparatus according to claim 6, wherein said ink lines are spaced apart about ⅛ inch.

9. A method of detection of a location comprising the steps of:

(a) forming a resistive matrix on a surface, said matrix formed from a plurality of spaced-apart first conducting lines and a plurality of spaced-apart second conducting lines intersecting with the first conducting lines to form a plurality of nodes;

(b) applying a voltage to the resistive matrix;

(c) measuring an operating parameter of at least some resistors in the matrix;

(d) continually scanning the grid and determining the values of said parameter of said some resistors;

(e) comparing each said scanning against stored results for detection of a matrix change; and (f) analyzing the matrix change by checking combinations of a possible resistor or resistors that have been removed, until the closest simulated value is determined, whereby, upon calculating which resistor or resistors have been removed, a precise location may be determined.

10. The method according to claim 9, wherein said step (f) is performed by a microprocessor.

11. The method according to claim 9, wherein said step (e) compares each said scanning by calculation of a nodal matrix solution using a matrix reduction technique.

12. The method according to claim 9, further comprising:

(g) revising said stored results to reflect removed resistors, in order to provide a new reference of stored results.

13. The method according to claim 9, wherein said step (a) comprises forming said plurality of first and second conducting lines into a target for use in target practice.

14. A system for precisely determining the location within a surface, comprising:

a surface having a resistive matrix pattern formed of a plurality of first electrically-conducting lines extending in a first direction, and a plurality of second electrically-conducting lines extending in a second direction, said plurality of first and second conducting lines overlapping at intersections and forming nodes thereat, said matrix pattern further comprising a first group of sense-resistor means and a second group of main resistor means interconnected by said plurality of first and second conducting lines;

means operatively associated with said matrix pattern for generating parametric values of said sense-resistor means; and computer means for determining the loss of a main resistor means associated with a respective said node by comparison to a computer simulation.

15. The system for precisely determining the location within a surface according to claim 14, wherein said means operatively associated with said matrix pattern for generating parametric values of the sense-resistor means at each said node comprises analog-to-digital conversion means for converting said parametric values into digital data; said computer means comprising memory means for analyzing said digital data in order to determine which resistor of the system has been removed.

16. The system for precisely determining the location within a surface according to claim 14, wherein said plurality of first electrically-conducting lines extend in the horizontal direction, and said plurality of second electrical and conducting lines extend in a vertical direction, said first lines being equally spaced-apart, and said second lines being equally spaced apart.

17. The System for precisely determining the location within a surface according to claim 14, wherein said sense-resistor means are located on the outer perimeter of said matrix pattern, and said main resistor means are located interiorly.

18. The system for precisely determining the location within a surface according to claim 14, wherein said computer means comprises means for generating a digital representation of a resistive matrix and a nodal matrix for solving by a numerical analysis, matrix-reduction technique.

19. A method of determining the loss of a electrical element, which electrical element is part of an array of electrical elements, by use of a successive approximation simulation method, comprising:

(a) generating a matrix-array model of said array of electrical elements by means of a computer program means;

(b) predicting which electrical element of said array is missing after having received sensing information indicating that an electrical element has been eliminated from said array, by means of a computer program means;

(c) said step (b) comprising modifying the matrix-array model of said step (a) by said computer program means;

(d) running simulations based on the modified matrix-array of said step (c);

(e) comparing the results of said step (d) with the actual sensed information of said array; and (f) repeating said steps (d) and (e) a plurality of times until the results of said step (d) match the actual sensed information of said array.

20. The method of determining the loss of a electrical element according to claim 19, wherein said electrical element is a resistor forming part of an array of resistors; said step (b) comprising predicting which resistor of said array is missing after having received sensed voltage information of said array indicating that a resistor has been eliminated from said array; and repeating said steps (b) through (f) for each additional resistor that has been removed from the array; said step of repeating said steps (b) through (f) comprising updating the matrix-array model after each missing resistor has been located.

* * * * *